US006825836B1

(12) United States Patent
Stewart et al.

(10) Patent No.: US 6,825,836 B1
(45) Date of Patent: Nov. 30, 2004

(54) BUS ARRANGEMENT FOR A DRIVER OF A MATRIX DISPLAY

(75) Inventors: Roger Green Stewart, Morgan Hill, CA (US); Frank Paul Cuomo, Morgan Hill, CA (US)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/700,359

(22) PCT Filed: May 11, 1999

(86) PCT No.: PCT/US99/10227

§ 371 (c)(1),
(2), (4) Date: Nov. 14, 2000

(87) PCT Pub. No.: WO99/60555

PCT Pub. Date: Nov. 25, 1999

Related U.S. Application Data

(60) Provisional application No. 60/085,766, filed on May 16, 1998.

(51) Int. Cl.[7] ..... G09G 5/00; G09G 3/18

(52) U.S. Cl. ..... 345/212; 345/55; 345/58; 345/213; 345/89

(58) Field of Search ..... 345/55, 58, 104, 345/204, 212, 213, 87–88, 99–100, 103, 89

(56) References Cited

U.S. PATENT DOCUMENTS

| | | | | |
|---|---|---|---|---|
| 4,906,071 | A | 3/1990 | Takahara et al. | 350/331 |
| 4,963,860 | A | 10/1990 | Stewart | 340/719 |
| 5,016,986 | A | 5/1991 | Kawashima et al. | 350/339 |
| 5,168,384 | A | 12/1992 | Genba | 359/83 |
| 5,170,155 | A | 12/1992 | Plus et al. | 340/784 |
| 5,353,196 | A | 10/1994 | Takahashi | 361/760 |
| 5,576,868 | A | 11/1996 | Togashi | 359/88 |
| 5,673,063 | A | 9/1997 | Weisbrod | 345/100 |
| 5,737,053 | A | 4/1998 | Yomogihara et al. | 349/149 |
| 5,757,450 | A | 5/1998 | Fujii et al. | 349/106 |

FOREIGN PATENT DOCUMENTS

| | | | |
|---|---|---|---|
| EP | 0402850 | 1/1995 | G09G/3/36 |
| EP | 0680082 | 5/1995 | H01L/21/60 |
| EP | 0828413 | 3/1998 | H05K/13/00 |
| WO | 97/00462 | 1/1997 | G02F/1/1345 |

*Primary Examiner*—Alecia Diane Nelson
(74) *Attorney, Agent, or Firm*—Joseph S. Tripoli; Harvey D. Fried; Sammy S. Henig

(57) ABSTRACT

A demultiplexer applies picture information to pixels arranged in an array of a display device having columns and rows. The demultiplexer includes transistor switches each having a control terminal, an input terminal and an output terminal. A first bus couples switch control signals to the control terminals of the switches. The conductors of a first bus extend in a region containing each of the switches to form a global bus arrangement. Local buses have each conductors coupled to the input terminals of the switches associated with the individual local bus. The output terminals of the switches associated with the individual local bus are coupled to corresponding, consecutively disposed column conductors of the array. The individual local bus has a section that crosses over the first bus and a second section extending between the crossover section and the input terminals of the associated switches. The conductors of the second section extend in a region containing the associated switches and are absent from regions containing switches associated with the other local buses to obtain bus separation forming a local clustering bus arrangement.

7 Claims, 3 Drawing Sheets

BUS ARRANGEMENT FOR A DRIVER OF A MATRIX DISPLAY

This application claims benefit of Ser. No. 60/085,766 filed May 16, 1998.

BACKGROUND OF THE INVENTION

1. Field of the Invention

This invention relates generally to a bus arrangement for display devices and particularly to a system for applying brightness signals to pixels of a display device, such as a liquid crystal display (LCD) or a plasma display, 2. Background of the Invention Display devices, such as liquid crystal displays or plasma displays, are composed of a matrix or an array of pixels arranged horizontally in rows and vertically in columns. The video information to be displayed is applied as brightness (gray scale) signals to data lines which are individually associated with each column of pixels. The rows of pixels are sequentially scanned and the capacitances of the pixels within the activated row are charged to the various brightness levels in accordance with the levels of the brightness signals applied to the individual columns.

Brightness information to be applied to the array of pixels may be formatted into M brightness information signals developed in M parallel brightness information carrying conductors, for example, M=100. The M brightness information signals are applied to an input port of an input demultiplexer of the array. During each horizontal line interval of the video signal, the demultiplexer converts the M brightness information signals to MXN signals developed in MXN parallel conductors that are coupled via MXN data line drives to MXN column conductors of the array. The input demultiplexer may be formed by MXN thin film transistor (TFT's). Groups of M parallel conductors are successively selected, during each horizontal line interval of the video signal. The selection of each group of M parallel conductors is obtained by selection pulse signals developed in a bus of N parallel conductors.

The capacitance of the input bussing structure associated with the N selection parallel conductors and the input bussing structure associated with the M brightness information carrying parallel conductors can be a major source of both power dissipation and yield loss, especially for higher resolution self-scanned Active-Matrix Liquid Crystal Displays (AMLCDs). Long metal runs across the display and multiple crossovers (Source/Drain metal-to-Gate metal) cause significant capacitive loads, resulting in both capacitance shorting failures, unwanted crosstalk among the brightness information carrying conductors and excessive dynamic power dissipation. It is desirable to reduce the number of crossovers of the input bussing structure associated with the N selection parallel conductors and of the input bussing structure associated with the M brightness information carrying parallel conductors.

SUMMARY OF THE PRESENT INVENTION

An arrangement, embodying an inventive feature, for transferring pixel information with respect to pixels arranged in columns and rows of an array of a display device includes semiconductor switches. Each switch has a first terminal, a second terminal and a third terminal. A first buss is coupled to a first plurality of terminals for communicating signals between the first plurality of terminals and the first terminals of the switches. Local busses that are separated from one another are provided. A given local buss has a first buss section coupled to a second plurality of terminals associated with the given local buss and extends in a manner to cross over the first buss. The local buss has a second buss section extending from the first buss section has conductors coupled in a local, clustering buss arrangement to the second terminals of switches associated with the given local buss. The associated switches have their third terminals coupled to consecutively disposed column conductors, respectively, of the array.

BRIEF DESCRIPTION OF THE DRAWING FIGURES

DETAILED DESCRIPTION OF THE INVENTION

Figure 1:
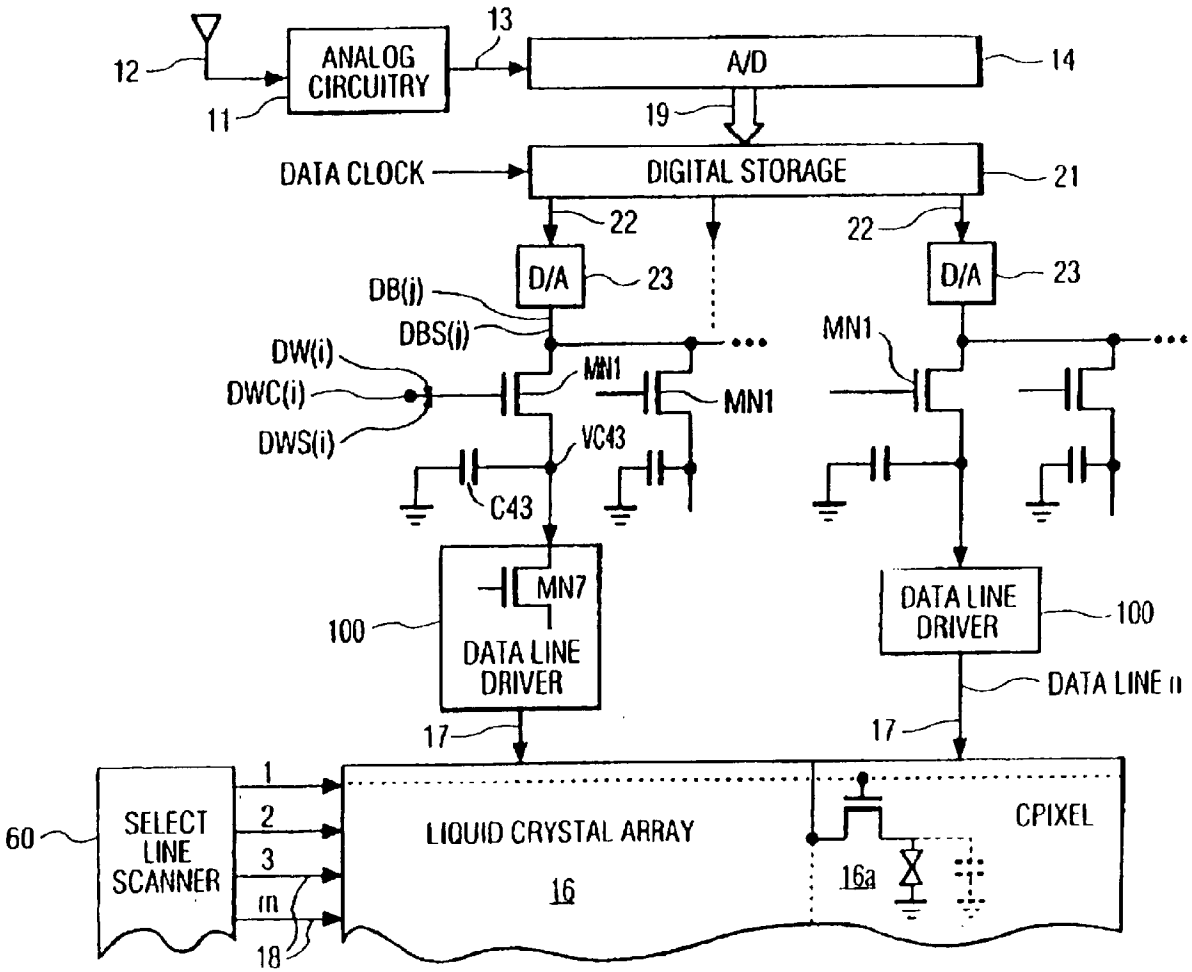
FIG. 1 illustrates an AMLCD with integrated driver circuits, according to an aspect of the invention, when incorporating the bussing arrangement of FIG. 3.

FIG. 1 illustrates an integrated driver arrangement for storing information in an SVGA liquid crystal array. It should be understood that the invention may be utilized for storing information in pixels of a plasma display. Analog circuitry 11 receives a video signal representative of picture information to be displayed from, for example, an antenna 12. The analog circuitry 11 provides a video signal on a line 13 as an input signal to an analog-to-digital converter (A/D) 14.

The television signal from the analog circuitry 11 is to be displayed on a liquid crystal array 16 which is composed of a large number of pixel elements, such as a liquid crystal cell 16*a*, arranged horizontally in m=600 rows and vertically in n=2400 columns. Liquid crystal array 16 includes n=2400 columns of data lines 17, one for each of the vertical columns of liquid crystal cells 16*a*, and m=600 select lines 18, one for each of the horizontal rows of liquid crystal cells 16*a*.

A/D converter 14 includes an output bus 19 to provide brightness levels, or gray scale codes, to a memory 21 having 100 groups of output lines 22. Each group of output lines 22 of memory 21 applies the stored digital information to a corresponding digital-to-analog (D/A) converter 23. There are 100 D/A converters 23 that correspond to the 100 groups of lines 22, respectively. An output analog signal DBS(j) from a given D/A converter 23 is coupled via a corresponding brightness information carrying conductor DB(j) to a demultiplexer transistor MN1 associated with a corresponding column. Transistors MN1 may be thin film transistors (TFTs). The symbol (j) assumes values from 1 to 100 associated with the 100 D/A converter 23. Demultiplexer transistor MN1 applies the information of signal DBS(j) developed on corresponding brightness information carrying conductor DB(j) to a corresponding sampling capacitor C43 for storing an analog signal VC43 in capacitor C43. Signal VC43 is coupled to a corresponding data line driver 100 that drives corresponding data line 17 associated with a corresponding column.

A select line scanner 60 produces row select signals in lines 18 for selecting, in a conventional manner, a given row of array 16. The voltages developed in 100 data lines 17 are applied during a 32 microsecond line time to pixels 16*a* of the selected row.

The sampling in a given group of 100 signals DBS(j) of FIG. 1 developed in brightness information carrying conductors DB(j) occurs simultaneously under the control of a corresponding data-word pulse signal DWS(i) forming a selection word. There are 24 pulse signals DWS(i), developed on 24 separate data-word conductors DW(i), that occur successively during a 32 microsecond horizontal line time. The symbol (i) assumes values from 1 to 24 associated with the 24 separate conductors DW(i). Each pulse signal DWS(i) controls the sampling of a corresponding group of 100 signals DBS(j) in capacitors C43.

To provide an efficient time utilization, a two-stage pipeline cycle may be used. Signals DBS(j) are demultiplexed and stored in 2400 capacitors C43 by the operation of pulse signals DWS(i). Then, the information in capacitors C43 is transferred simultaneously to data line driver 100. Thus, capacitors C43 become available for the demultiplexing of the next row information, while the previous row information is applied to the pixels.

Except for the bussing arrangement, as described later on, the circuitry of FIG. 1 may operate, for example, similarly to that described in, for example, U.S. Pat. No. 5,673,063 in the name of Sherman Weisbrod, entitled "A DATA LINE DRIVER FOR APPLYING BRIGHTNESS SIGNALS TO A DISPLAY". A possible bussing arrangement of conductors DW(i) and DB(j) is explained in connection with FIG. 2. The bussing arrangement of conductors DW(i) and DB(j), embodying an inventive feature, is explained in connection with FIG. 3. Similar symbols and numerals in FIGS. 1, 2 and 3 indicate similar items or functions.

As explained before, the crossover capacitance of the input bussing structure associated with conductors DW(i) and DB(j) can be a major source of both power dissipation and yield loss, especially for higher resolution self-scanned Active Matrix Liquid Crystal Displays (AMLCDs). Long metal runs across the display and multiple crossovers (Source/Drain metal-to-Gate metal) cause significant capacitive loads, resulting in both capacitance shorting failures, unwanted crosstalk among the brightness information carrying conductors, and excessive dynamic power dissipation. The bussing arrangement of FIG. 3 reduces the number of capacitive crossovers associated with the input buss structure thus reducing the power dissipation and improving yield.

Figure 2:
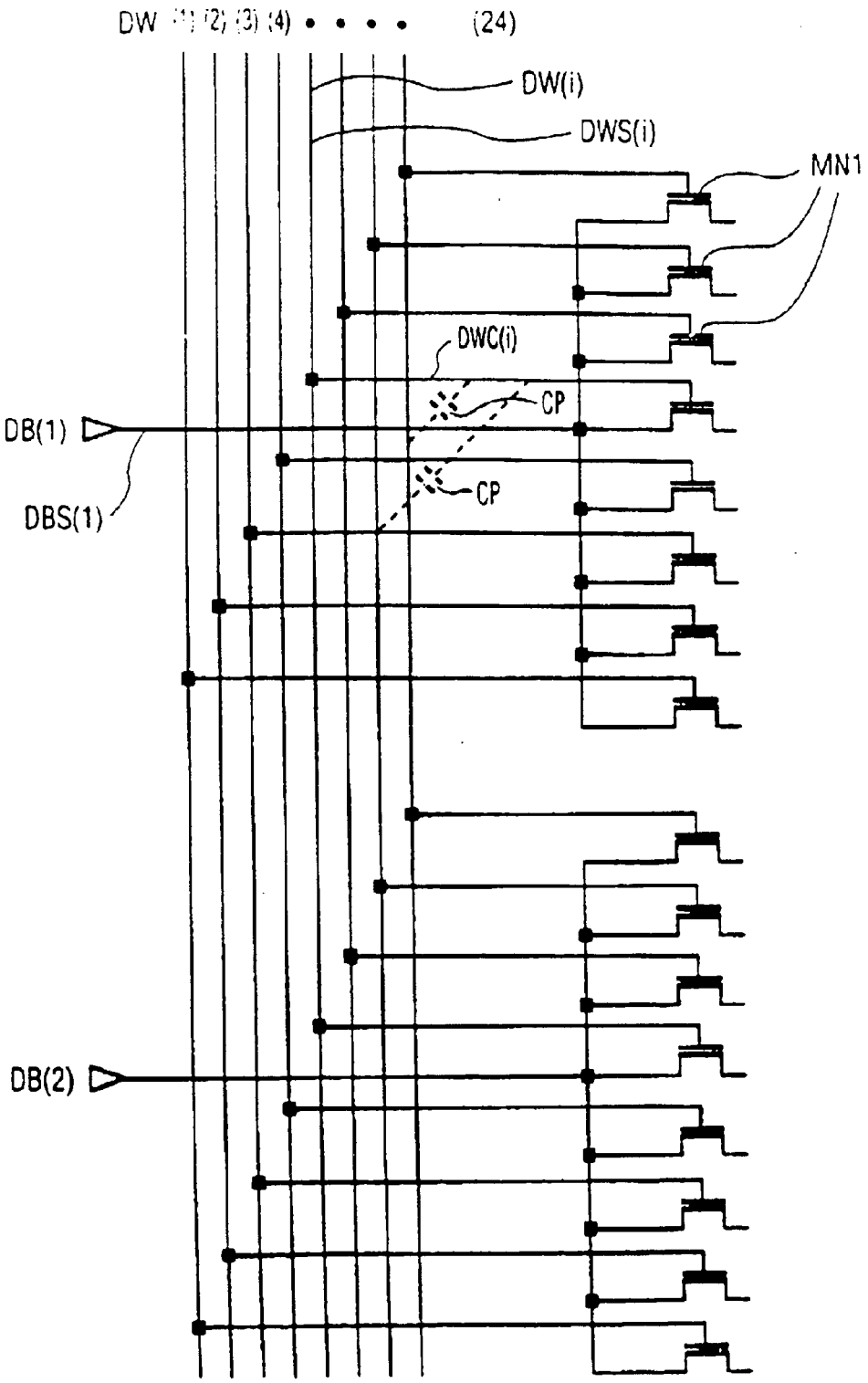
FIG. 2 PRIOR ART
FIG. 2 illustrates a prior art bussing structure.

In the bussing arrangement of FIG. 2, all conductors DW(i), that develop gate signals DWS(i) of demultiplexer transistor MN1 of FIG. 1, are bussed together or globally across the entire display. Each column of the array is associated with a corresponding transistor MN1 having a gate electrode connected to one of those buss conductors DW(i) via a corresponding extention conductor DWC(i). Connection of extention conductor DWC(i) to the corresponding buss conductor DW(i), located closest to data scanner transistors MN1, does not cause excessive capacitance problem. However, making connection of a given extention conductor DWC(i) to the corresponding buss conductor DW(i) that is furthest away from data scanner transistors MN1 means that extension conductor DWC(i) must cross all of the other buss conductors DW(i) to which it is not connected. Capacitive coupling CP to the other conductors DW(i), is incurred at each cross over as shown in FIG. 2.

Disadvantageously, the number of capacitive crossovers increases geometrically with the number of data-word conductors DW(i) according to the equation: number of crossovers=number of brightness information carrying conductors DB(j)×½×(number of data-word conductors DW(i)). It may be desirable to reduce the number of times conductors DWC(i) cross the buss of conductors DW(i) so as to reduce dynamic power dissipation and improve yield.

Figure 3:
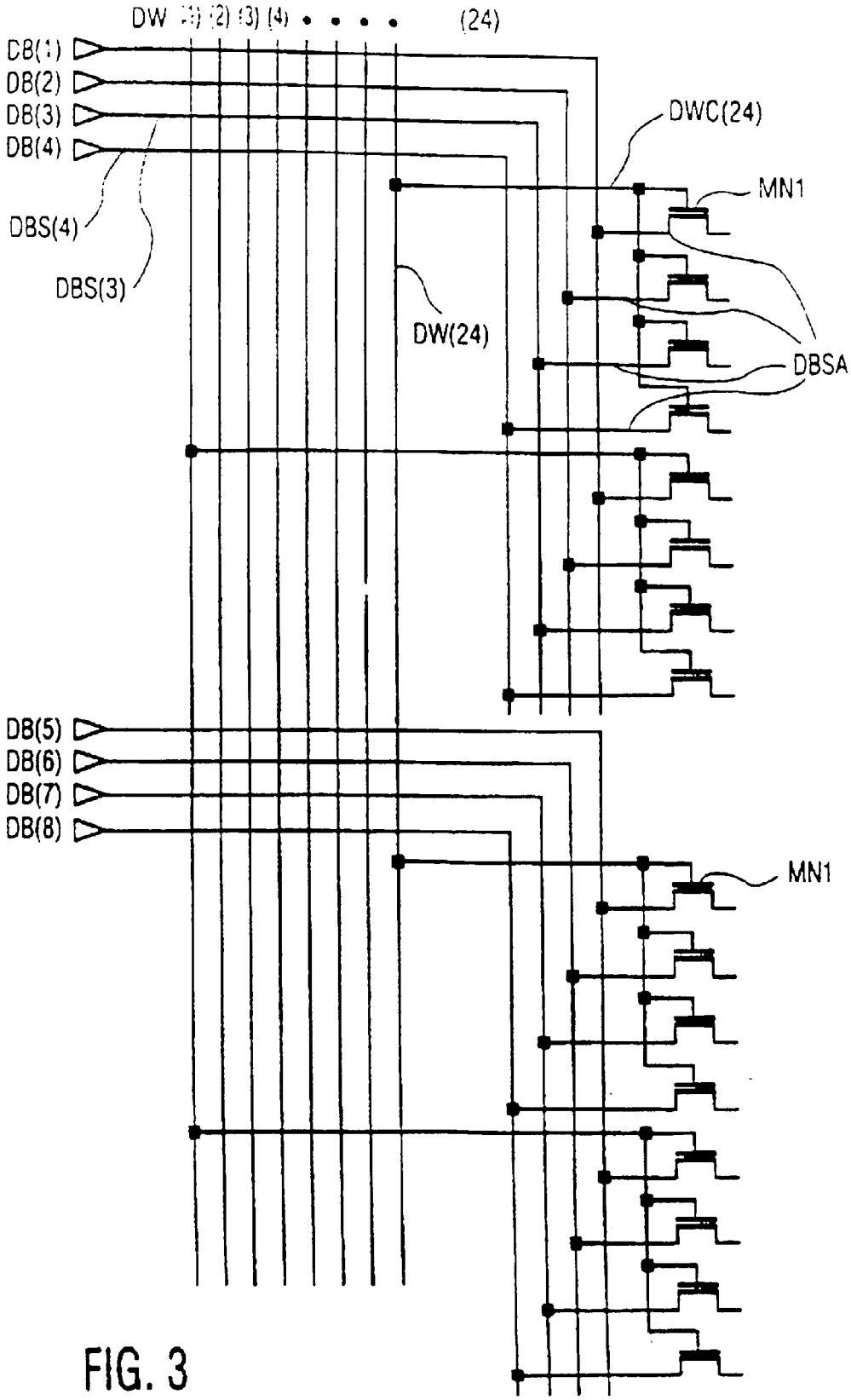
FIG. 3 illustrates a bussing structure, in accordance with an aspect of the invention, that may be incorporated in the arrangement of FIG. 1.

As shown in FIG. 3, in a "cluster bussing" buss structure, embodying an inventive feature, the brightness information carrying conductors DB(j), instead of being arranged individually and uniformly across the display, are grouped together into local "clusters" such as, for example, brightness information carrying conductors DB(1)–DB(4). The cluster of brightness information carrying conductors DB(1)–DB(4) are coupled to four transistors MN1 having gate electrodes that share, in common, conductor DW(24). In this example, the number of crossovers of brightness information carrying conductors DB(j)-to-data-word conductors DW(i) have been reduced by a factor of about 4:1. This, advantageously, reduces dynamic power dissipation, improves yield and reduces the crosstalk among the brightness information carrying-conductors.

In the arrangement of FIG. 2, transistors MN1 associated with 24 adjacent columns of matrix 16 of FIG. 1 have gates that are controlled by consecutive data-word signals DWS(i) and apply a common signal DBS(i) to the corresponding columns. In comparison, in the arrangement of FIG. 3, transistors MN1 associated with 4 adjacent columns of matrix 16 of FIG. 1 have gates that are controlled by common data-word signal DW(24) and apply 4 different signals DBS(i) to the corresponding columns.

The cluster bussing arrangement adds a multiplicity of new local sub-arrays DBSA to the bus structure. Although these new local sub-arrays do add some additional crossovers of their own (2.5 per brightness information carrying conductor), this is a small price to pay for reducing the average number of crossovers in the main brightness information carrying conductor to data-word conductor matrix from 20/data-line to only 5/data-line. The total capacitive coupling in the input buss structure is thereby cut by a factor of approximately 4 using the cluster buss technique. For example: in a display with 100 DB(j) and 24 DW(i) the total number of crossovers is 28,800 using the buss technique of FIG. 2, while cluster bussing of FIG. 3 yields 7450 total crossovers.

The primary advantages of cluster bussing, therefore. include higher yield, lower power dissipation, and reduced crosstalk. However, another advantage to cluster bussing is that we now break up the pattern of consecutive columns connected to a single signal DBS(j). Small errors in signal DBS(j)-to-signal DBS(j) will normally result in noticeable "block" errors because the human eye is very sensitive to large block patterns. Using the cluster buss technique, the blocks are broken-up into a finer pitch that is, advantageously. less obvious to the viewer.

Thus, whenever demultiplexing is done with a matrix of 2 signal types involving typically 20 or more lines, the structure may be improved through the addition of clusters of sub-arrays to reduce the complexity and capacitance of the main array.

What is claimed is:

1. An arrangement for transferring pixel information with respect to pixel arranged in columns and rows of an array of a display device, comprising:

a plurality of semiconductor switches, each having a first terminal, a second terminal and a third terminal, said plurality of semiconductor switches being separated into groups of semiconductor switches and each one of said groups of semiconductor switches being separated into subgroups of semiconductor switches;

a control bus having a plurality of conductors, each conductor of said control bus being coupled to said first terminal of respective ones of each of said plurality of semiconductor switches for communicating corresponding signals; and a plurality of local buses that are separated from one another for communicating corresponding signals, each of said plurality of local buses being associated with a respective group of semiconductor switches and having a plurality of conductors, each of said plurality of conductors of said plurality of local buses having a first bus section extending in a manner to cross said plurality of conductors of said control bus once and a second bus section connected to an end of said first bus section and coupled in a local, clustering bus arrangement to the second terminal of a respective semiconductor switch within each subgroup of the respective group of semiconductor switches, the associated switches having the third terminals thereof coupled to the consecutively disposed column conductors of the array of the display device.

2. An arrangement according to claim 1 wherein said first plurality of terminals receive switch control signals and said second plurality of terminals receive picture information signals for said switches for storing the picture information in said pixels of said array.

3. An arrangement according to claim 1, wherein said associated switches including a plurality of sub-groups of switches, the switches of a given sub-group having the first terminals thereof coupled in common to a corresponding conductor of said first bus and the third terminals thereof being coupled to consecutively disposed column conductors, respectively of said array.

4. An arrangement according to claim 1, wherein the conductors of said second bus section of said given local bus we disposed proximate said switches associated with said given bus and remote from switches associated with the other local buses of said plurality of local buses to provide bus separation.

5. An arrangement according to claim 1, wherein the conductors of said first bus extend along each of said plurality of semiconductor switches to form a global bus arrangement.

6. An arrangement according to claim 1, wherein said third terminal of each of said semiconductor switches is coupled to an input terminal of a corresponding data line driver.

7. A signal demultiplexer for a display panel, comprising:

a plurality of switch groups, each switch group including a plurality of subgroups, each subgroup having ordinally numbered switches 1 thru n arranged sequentially, and each switch having respective input, output and control terminals with the control terminals of all switches in each subgroup being connected to a common control terminal, and having respective output terminals coupled to successive data lines on the display panel;

a plurality of groups of data buses, each group of data buses being associated with a respective switch group having ordinally numbered conductors 1 thru n, the ordinally numbered conductors of respective groups of data buses being coupled to input terminals of a corresponding ordinally numbered switch of each subgroup within the respective switch group; characterized by a control bus including a plurality of conductors, said plurality of groups of data buses having a first bus section extending in a manner to cross said plurality of conductors of said control bus once and a second bus section connected to an end of said first bus section and coupled in a local, clustering bus arrangement to the second terminal of a respective semiconductor switch within each subgroup of the respective group of semiconductor switches; and connections between ones of said plurality of conductors of said control bus and a common control terminal of a respective subgroup within each of said plurality of switch groups.

* * * * *